US005528219A

United States Patent [19]

Frohlich et al.

[11] Patent Number: 5,528,219

[45] Date of Patent: Jun. 18, 1996

[54] ROPEWAY SAFETY MONITORING SYSTEM

[75] Inventors: Sigurd Frohlich, San Diego; Hans Koellner, Santa Barbara, both of Calif.; Reinhold Zauner, Bregenz, Austria; Georg Schurian, Kelowna, Canada

[73] Assignee: Konrad Doppelmayr & Sohn, Wolfurt, Austria

[21] Appl. No.: 234,572

[22] Filed: Apr. 28, 1994

[51] Int. Cl.[6] ..... G08B 21/00

[52] U.S. Cl. ..... 340/540; 104/178; 104/179; 340/521; 340/679

[58] Field of Search ..... 340/540, 521, 340/679; 104/178, 179

[56] References Cited

U.S. PATENT DOCUMENTS

| | | | |
|---|---|---|---|
| 2,957,126 | 10/1960 | Wright | 324/207.22 |
| 3,302,588 | 2/1967 | Bennett | 104/178 |
| 3,347,172 | 10/1967 | Sowder | 104/173.1 |
| 3,348,499 | 10/1967 | Sowder | 104/178 |
| 3,759,185 | 9/1973 | Scherbatskoy | 104/112 |
| 4,003,314 | 1/1977 | Pearson | 104/178 |
| 4,088,952 | 5/1978 | Sikora | 324/207.16 |
| 4,088,988 | 5/1978 | Berger | 340/679 |
| 4,269,123 | 5/1981 | Segafredo | 104/178 |
| 4,271,763 | 6/1981 | Berger | 104/179 |
| 4,297,683 | 10/1981 | Roberts | 340/540 |
| 4,327,646 | 5/1982 | Nakata et al. | 104/89 |
| 4,329,926 | 5/1982 | Sowder et al. | 104/179 |
| 4,462,314 | 7/1984 | Kunczynski | 104/115 |
| 4,617,829 | 10/1986 | Tarassoff | 73/865.8 |
| 4,640,197 | 2/1987 | Brian | 104/179 |
| 4,671,187 | 6/1987 | Kunczynski | 104/179 |
| 4,697,169 | 9/1987 | Bertrand | 340/540 |
| 4,851,770 | 7/1989 | Fiori, Jr. | 324/207.22 |
| 4,926,754 | 5/1990 | Feuz | 104/112 |
| 4,943,772 | 7/1990 | Maupu et al. | 324/207.2 |

*Primary Examiner*—Glen Swann
*Attorney, Agent, or Firm*—Thomas J. Tighe

[57] ABSTRACT

Sensors distributed along a ropeway communicate with a base station and preferably a base station computer. One type of sensor detects and signals cable misalignments from a normal line of cable traction. Preferably each cable tower has at least one such sensor. Another type of sensor is mounted on a sheave assembly and detects vibrations characteristic of disintegration within the assembly. It produces a sheave problem signal whenever such occurs. Preferably there is one vibration sensor mounted on each sheave assembly. Another type of sensor is preferably mounted on each ropeway carrier for detecting and signaling excessive swings. The sensor signals are communicated to a cable operator so that remedial action can be taken. Each carrier sensor has an RF transmitter for broadcasting its signals to RF receivers mounted on cable towers. Interface units local to sensor groups relay their signals to a base station computer that provides corresponding indicators to the cable operator. Preferably ropeway carrier transmitters and tower receivers are spread spectrum for immunity from outside interference. Preferably the interface units and the base computer communicate via a common data network. Each carrier can also have one or more code transponders which communicate certain unique codes to the base station each time the carrier passes by the station.

65 Claims, 6 Drawing Sheets

ROPEWAY SAFETY MONITORING SYSTEM

BACKGROUND OF THE INVENTION

This invention relates in general to systems for monitoring the safety of ropeways, i.e., cable-supported aerial tramways, and in particular to such systems having a network of remote safety sensors distributed along the systems' ropeways for detecting unsafe or potentially unsafe conditions and for producing alarm signals in response thereto that are communicated to ropeway operators.

SUMMARY OF THE INVENTION

The terms "ropeway carrier" and "carrier" are used herein in a generic sense to mean any chair, basket, gondola, container, platform, T-bar or other carrier suspended from a ropeway cable for carrying people and/or material. The term "tower" refers to any ropeway cable support structure.

An object of this invention is to provide a quick and effective system for detecting certain abnormal or unsafe conditions in a ropeway.

A further object of this invention is to provide a quick and effective system for detecting an abnormal or unsafe shift in the position of a magnetically permeable ropeway cable.

A further object of this invention is to provide a system for detecting an abnormal or unsafe shift in the position of a magnetically permeable ropeway cable within a sheave in order to take remedial action before the cable jumps out of the sheave.

A further object of this invention is to provide a system for detecting an abnormal or unsafe shift in the position of a magnetically permeable cable within a sheave as an indication of a possible disintegration of a sheave.

A further object of this invention is to provide a system for detecting the early stages of disintegration of a ropeway cable sheave assembly, especially a sheave, in order to provide a warning before support of a cable riding the sheave assembly is effected.

A further object of this invention is to provide a system for detecting the early stages of a disintegration of a cable sheave in order to provide a warning before the sheave assembly is further damaged.

A further object of this invention is to provide a system including a quick and effective means for detecting an unsafe inclination or swing of a ropeway carrier to at least provide a warning so that remedial action can be taken before the carrier is struck and/or dislodged from the cable.

A further object of this invention is to detect inclination of the ropeway carrier due to swinging motion at a point before the inclination is unsafe.

These objects, and other objects expressed or implied in this document, are accomplished by a system for monitoring the safety of a ropeway having at least one, i.e., one or more cable position sensors, responsive to misalignments of the cable from a normal line of cable traction, for producing signals ("cable misalignment signals") corresponding to the misalignments. Preferably each cable tower has a cable position sensor for each cable or cable run supported by the tower. The system can also have at least one, i.e., one or more sheave vibration sensors, mounted on respective cable sheave assemblies and responsive to vibrations in the cable sheave assemblies that are at least characteristic of disintegration within a sheave assembly, for producing a signal ("sheave problem signal") corresponding thereto. Preferably there is one vibration sensor mounted on each sheave assembly. The system also preferably has at least one, i.e. one or more ropeway carrier inclination sensors, mounted on respective ropeway carriers supported by the cable, each responsive to an excessive swing of its host carrier, for producing a signal ("excessive swing signal") corresponding thereto. These problem identifying signals are communicated to a cable operator so that the operator can take remedial action. An embodiment of the cable position sensor has an inductive device, mounted on at least one cable sheave assembly, for producing magnetic flux and for sensing the position of the cable relative to said normal line of cable traction as a function of the amount of said magnetic flux permeating the cable. An embodiment of the vibration sensor has a transducer for transducing vibrations within the sheave assembly to a corresponding signal, and a mechanical high pass filter for filtering-out components of the signal corresponding to vibrations produced by normal operation of the sheave assembly, components of the signal not filtered-out being a sheave problem signal. An embodiment of the ropeway carrier inclination sensor has a tilt switch for producing a signal ("tilt signal") whenever the carrier is inclined beyond a predetermined threshold angle of inclination, a processor for at least measuring the duration and repetition rate of tilt signals, and for producing an excessive swing signal whenever a duration or a repetition rate exceeds a predetermined corresponding threshold. Each carrier having an inclination sensor also has an RF transmitter for broadcasting excessive swing signals originating therefrom, and the system includes at least one RF receiver, mounted on a cable support structure ("tower"), for receiving broadcasted excessive swing signals. An interface unit local to each sensor (e.g. mounted on the same tower as the sensor) relays the sensor's signals to a base computer that provides corresponding indicators to the cable operator. An interface unit local to each RF receiver (e.g. mounted on the same tower as the receiver) relays the received signals to the base computer. Preferably the ropeway carrier transmitters and the tower receivers use spread spectrum technology to enhance their immunity to outside interference. Preferably the interface units and the base computer communicate via a common data network. Each ropeway carrier can also have one or more code transponders which can communicate certain unique codes to corresponding base station transceivers over a very short distance, for example, tens of feet. Preferably each excessive swing signal transmitter has a unique code, and each time the transmitter's host carrier passes through the base station a transceiver in communication with the base station computer emits a pulse to trigger the transmitter code transponder. The transponder responds by transmitting the requested code. In this way the base station computer can keep track of the exact whereabouts of each ropeway carrier on a cable simply by knowing the number and distribution of carriers on the cable. Likewise, each ropeway carrier and each carrier clamp can have unique codes and a similar transponder/transceiver arrangement to allow the system to control its carrier inventory and to schedule clamp maintenance or replacement according to the number of times a clamp is used.

DESCRIPTION OF THE PREFERRED EMBODIMENT

Figure 1:
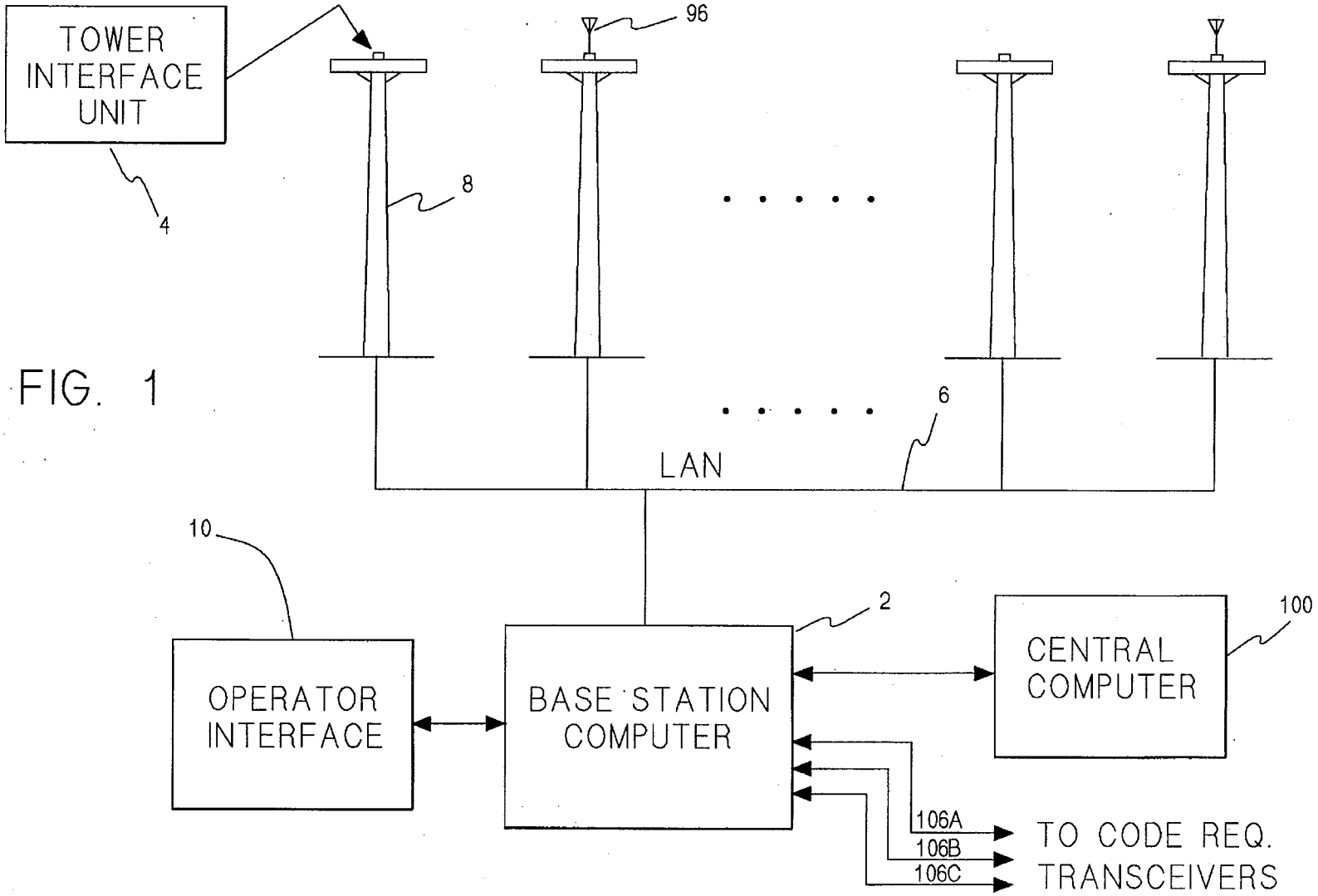
FIG. 1 is a functional block diagram providing an overview of, among other things, a communication network between a base computer and a plurality of cable tower interface units, all part of a system according to this invention.
Figure 2:
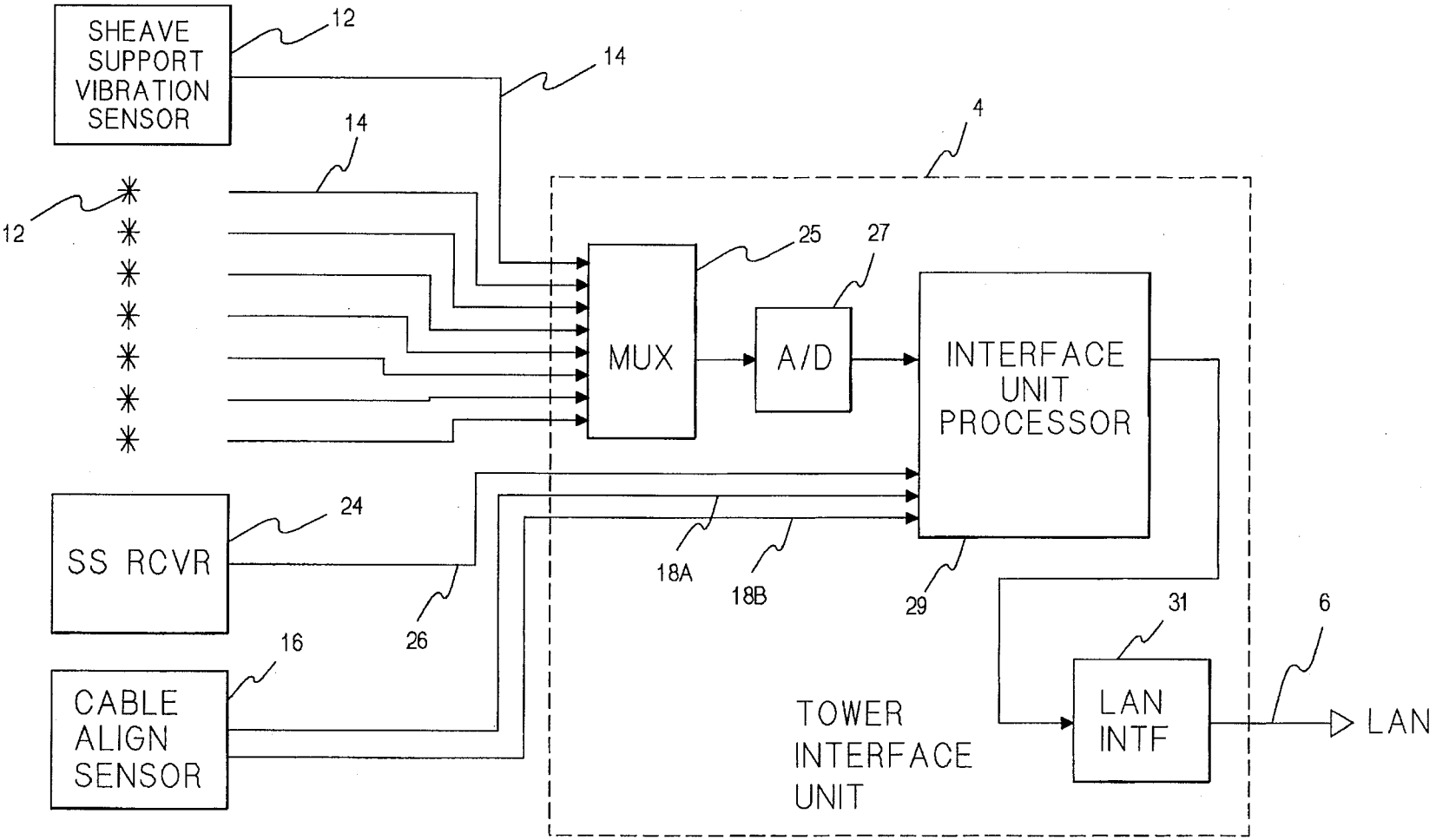
FIG. 2 is a functional block diagram of a tower interface unit and its links with a plurality of sensors local to it.

Referring to FIGS. 1 and 2, a system according to this invention is illustrated to have a base station computer 2 that communicates with a plurality of remote tower interface units 4 via a local area network (LAN) 6. The tower interface units are located at respective towers 8. Each tower interface unit monitors a plurality of sensing devices that are local to it. A primary function of the base station computer is to constantly request status reports from the tower interface units concerning the sensing devices, and provide corresponding real-time status information for an operator. The status report requests can be sequential to each tower. The base station computer processes the information it receives from the tower interface units, looking for dangerous conditions. Preferably the information is processed using plausibility and correlation algorithms to enhance the reliability of the results. The base station computer can have a variety of indicators 10 for communicating a dangerous condition to an operator, such as a monitor screen and other optical, acoustical, graphical and/or alphanumeric alarms and displays.

Referring again to FIGS. 1 and 2, one type of sensing device can be a sheave support vibration sensor 12. Each such sensor is affixed to a sheave assembly supporting member, such as a sheave support bar, to sense vibrations that are characteristic of disintegration within the assembly, such as a sheave that is disassembling. Preferably a vibration sensor is affixed to each sheave support bar. As more fully described below, each vibration sensor produces an analog signal 14, corresponding to vibrations of the support bar to which it is affixed. The analog signal is preconditioned and communicated to a tower interface unit local to the tower on which the sensor is located.

Referring again to FIGS. 1 and 2, a second type of sensing device can be a cable alignment sensor 16 which provides information concerning any lateral movement of a cable from its line of traction. Preferably each tower has one such sensor for each cable run supported by the tower. For example, a tower having one sheave assembly for supporting a cable in its forward run and another sheave assembly for supporting the cable in its return run would have two cable alignment sensors, each such sensor located behind the first sheave (with respect to the direction of traction) of its respective sheave assembly. As more fully described below, each cable alignment sensor provides an output 18 corresponding to a frequency differential that contains information about the location of the cable it is sensing relative to its axis of traction. This information is communicated to a tower interface unit local to, i.e., mounted on the tower on which the sensor is located.

Figure 14:
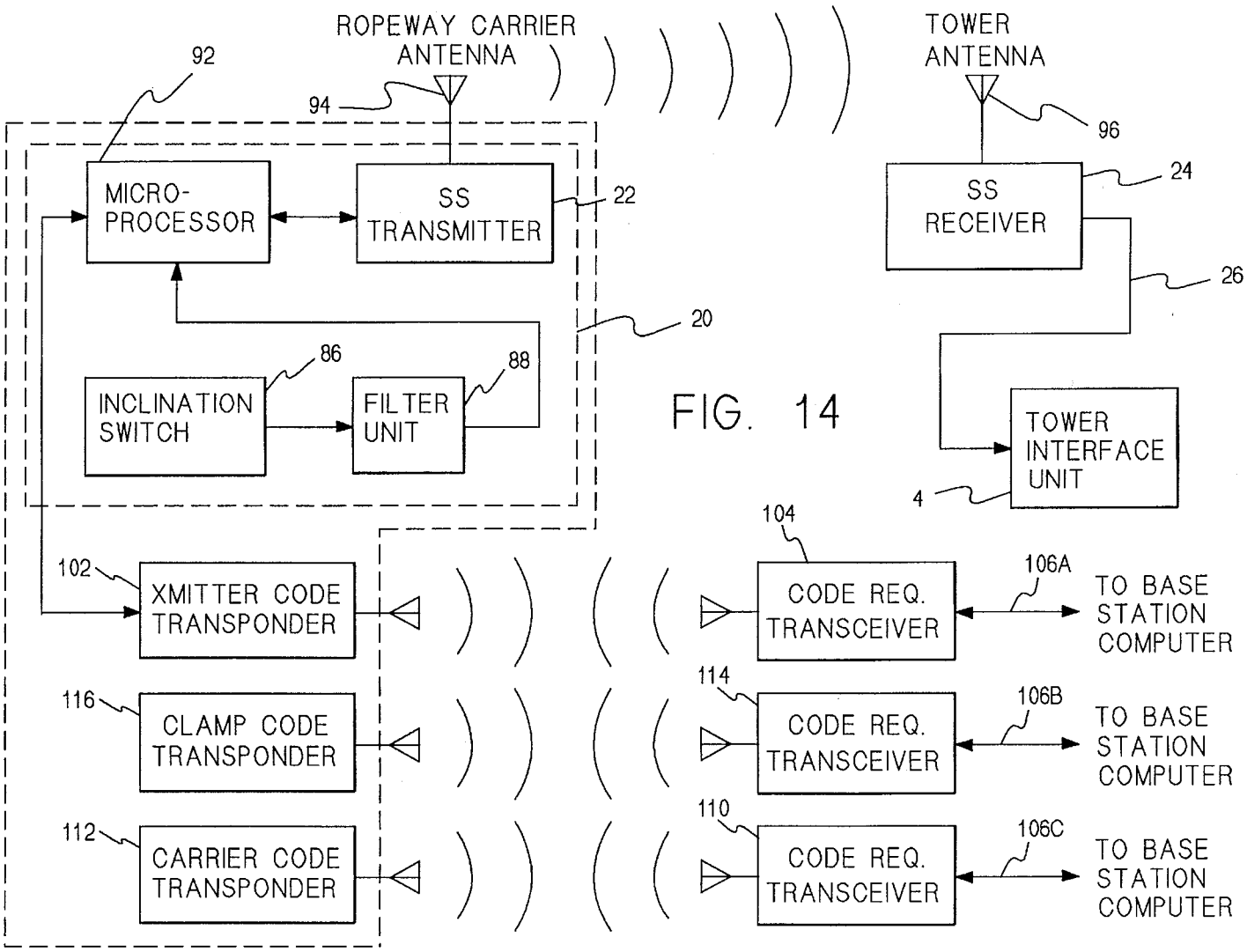
FIG. 14 is a functional block diagram of a ropeway carrier inclination sensor communicating with a tower interface unit.

Referring to FIGS. 1, 2 and 14, a third type of sensing device can be an inclination sensor 20 mounted on each ropeway carrier that detects unsafe and/or excessive carrier swings. As will be more fully described below, the sensor includes a spread spectrum RF transmitter, and if a swing is determined by the sensor to be unsafe or excessive, the transmitter will be triggered to broadcast a corresponding signal. The signal will be picked-up by one or more spread spectrum receivers 24 located on respective towers within range of the broadcast. The receivers will in turn communicate corresponding signals 26 to their respectively local tower interface units. Also, each inclination sensor can periodically broadcast a status signal to indicate its functionality.

Referring again to FIGS. 1 and 2, as illustrated each tower interface unit 4 local to, or mounted on, a tower 8 monitors eight sheave support vibration sensors 12 and two sets of cable alignment sensors 16 local to the unit, and monitors a local spread spectrum RF receiver 24 (SS RCVR) for signals from ropeway carriers within broadcast range of the receiver. The number and types of devices monitored by the tower interface units can be more or less than those just described, as desired. The outputs 14 from the vibration sensors are applied as inputs to a signal multiplexer 25 (MUX) the output of which is communicated to an analog-to-digital converter circuit 27 (A/D). The output of the A/D circuit is communicated to an input port of an interface unit processor 29, such as a microprocessor with program and data memory. The selection of signals through the MUX can be controlled by a sequencing circuit (not shown) or by the microprocessor. The output 26 of the RF receiver is in digital form and therefore does not need to be converted and goes directly to an input port of the processor. The cable alignment sensor provides two pulse train inputs, 18A and 18B, to the processor, the periods of the pulse trains corresponding to the frequencies of respective oscillators—as will be more fully explained below. The interface unit processor communicates with the base station computer 2 through the LAN 6 via a LAN interface 31 (LAN INTF). Interface unit can also have a "watch dog" circuit (not shown) to periodically notify the base computer that it and all sensors monitored by it are working properly. The interface units and receivers are housed in weather-proof enclosures.

Referring to FIGS. 2—5, a sheave support vibration sensor 12 is designed to monitor the vibration frequencies generated by a sheave pair assembly 28 using a piezoelectric transducer 30. A piezoelectric crystal generates a voltage if mechanical stress is placed across one axis. In order to measure vibration with a piezoelectric element, acceleration must be transformed into pressure. Since, when sensing the vibration of a surface with a piezoelectric element, a constant pressure signal is not relevant, an acceleration can be transformed into pressure by simply putting a mass 32 on top. In addition, the electrical signal can be amplified for certain frequencies, when the mass is spring loaded on the surface of the piezoelectric element. In this case, at a defined acceleration, the mass will lose contact with the surface and eventually bounce back and pound the piezoelectric element, generating a higher voltage. Since, for a given pressure, the piezoelectric element always generates the same voltage amplitude, regardless of the frequency of the vibration, it is important to enhance the frequency band which contains relevant information.

The sheave sensor is effective for detecting disintegration of a sheave because when a sheave side plate becomes broken or lose, it will rub up against its adjacent sheave support bar. This rubbing is metal on metal and causes vibrations which are characteristic of the event. The sensor of this invention is aimed at detecting these vibrations and communicating them to a base station for at least sounding an alarm so that quick remedial action can be taken.

Figure 3:
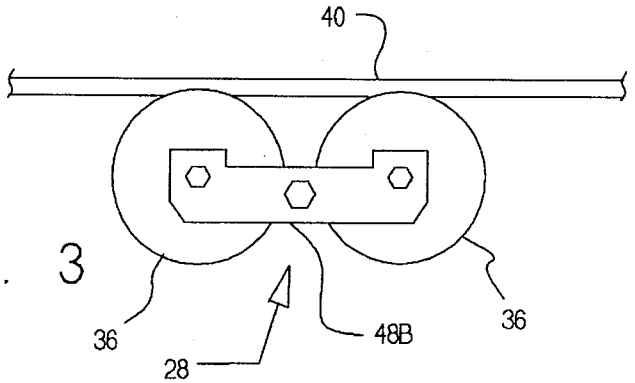
FIG. 3 is a side elevational view of a sheave pair assembly supporting a cable, the assembly being a pair of cable sheaves tied together by a sheave pair support bar.
Figure 4:
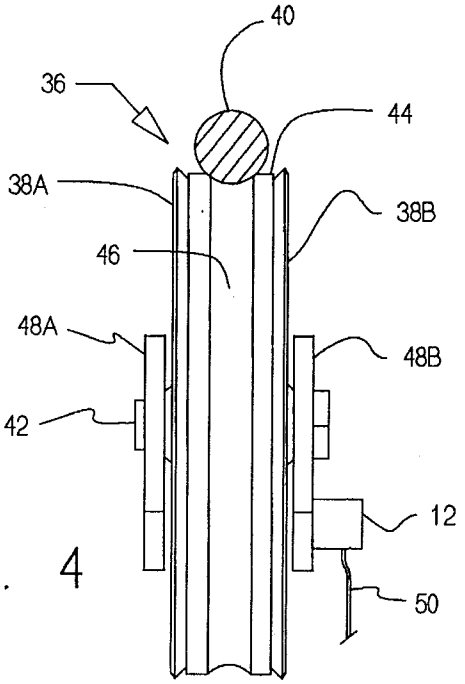
FIG. 4 is an end elevational view of the sheave pair assembly of FIG. 3 with a vibration sensor according to this invention attached to the sheave pair support bar.
Figure 9:
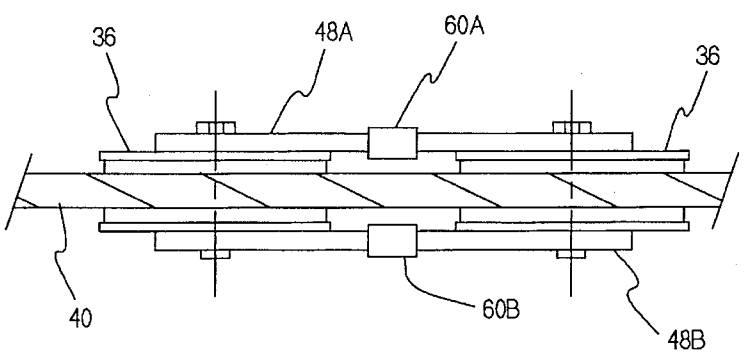
FIG. 9 is a plan view of a sheave pair assembly showing a pair of cable alignment sensors mounted on sheave support bars and disposed astride the line of cable travel.
Figure 6:
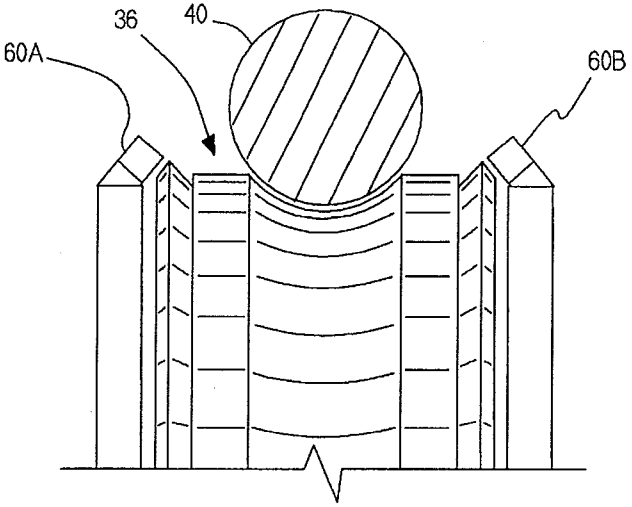
FIG. 6 is a partial end view of a cable sheave, with a cable thereon, and a pair of cable alignment sensors mounted astride the line of the cable.
Figure 7:
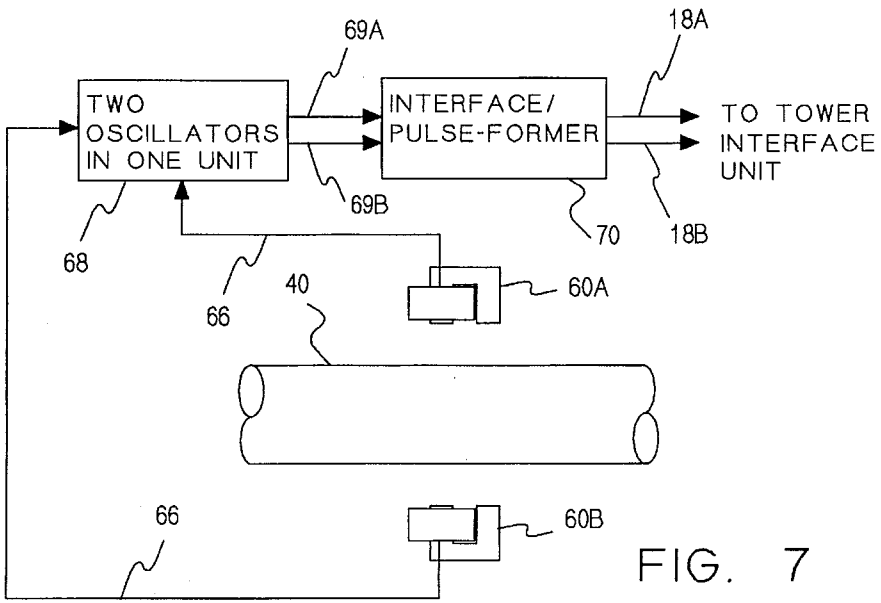
FIG. 7 is a functional block diagram of a cable alignment sensor according to this invention.
Figure 8:
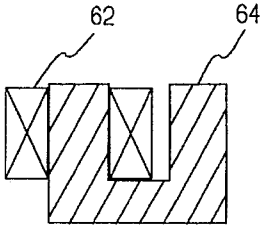
FIG. 8 is a cross-sectional view of an inductive detector according to this invention.

Referring to FIGS. 3 and 4, a sheave assembly 28 is illustrated to have two planarly aligned sheaves 36 journaled in and tied together in spaced relation by sheave support bars, 48A and 48B. Riding on the sheaves is a cable 40, commonly called a rope. The sheave assembly is held aloft by a tower (not shown), conventionally by a pinion connection 42. Each sheave includes a circular disk 44 defining a relatively shallow, centered groove 46 around the disk's edge, the groove in which the cable rides. The grooved disk is affixed to and between circular side plates, 38A and 38B, that are concentric with the disk but of larger diameter to form rims. The vibration sensor 12 is mounted on an outside sheave support bar 48B. The sensor includes a communication line 50 for sending its output to the tower's interface unit.

Figure 5:
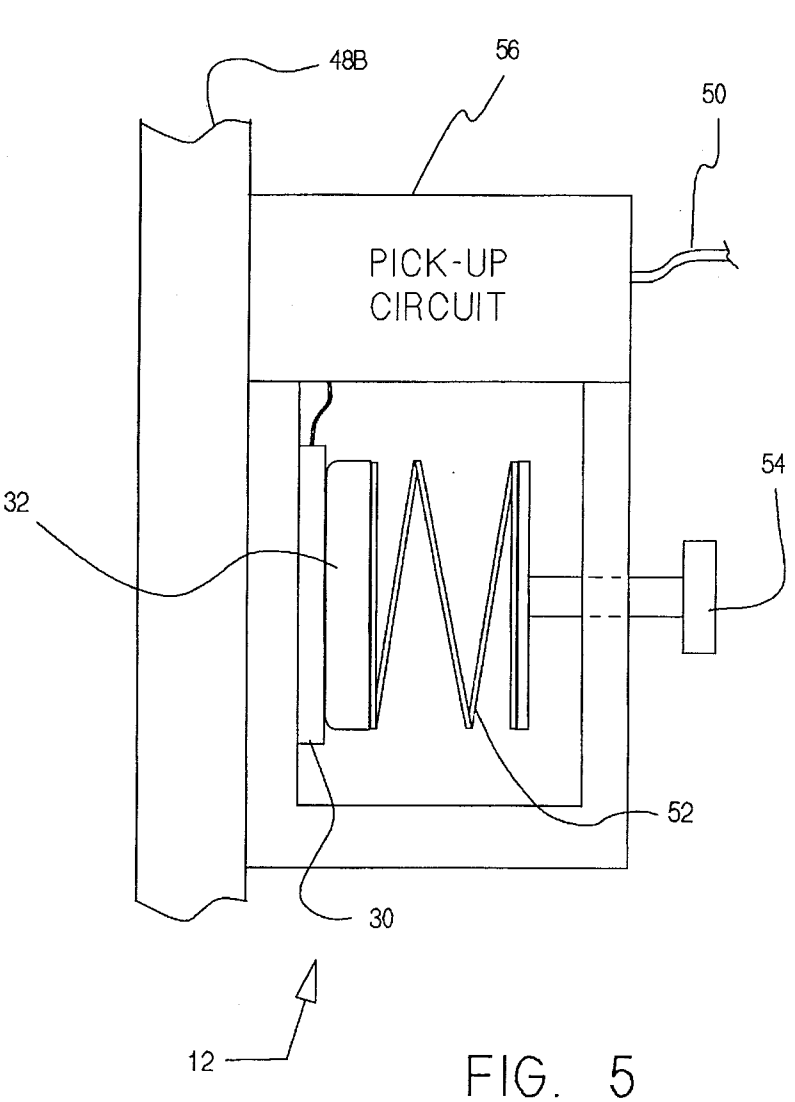
FIG. 5 is a diagrammatic representation of the vibration sensor.

Referring to FIG. 5, the sensor 12 includes the piezoelectric element 30 that transduces mechanical pressure or shock vibrations into corresponding electric signals. The free floating mass 32 is loaded by a spring 52 against the surface of the piezoelectric element. The force of the spring is adjustable, as by screw 54, in order to change the sensitivity at various frequencies so that under normal operation the vibration generated by the movement of the sheaves cannot accelerate the mass so much that it leaves the surface of the Piezo. In this way the spring-loaded, free-floating mass acts as a mechanical high pass. Under normal conditions a low frequency signal will be generated due to normal variations in pressure on the surface of the piezoelectric element. If the side plate of a sheave cracks and starts coming off, however, it will scratch at the support bar causing a high frequency vibration. This vibration will accelerate the mass on the surface of the piezoelectric element so much that it leaves the surface. It will then bounce back and pound the piezoelectric element. This pounding causes the piezoelectric element to generate a high voltage and high frequency signal (relative to the frequencies generated during normal operation of the sheave assembly) which will be communicated to a "pick-up" circuit 56. The pick-up circuit contains a high pass filter to remove any direct current (DC) component from the piezoelectric signal and amplification to translate the filtered signal to within a voltage range suitable for the A/D converter 27 (FIG. 2) in the local interface unit. A communication line 50 sends the output of the pick-up circuit to the interface unit for subsequent communication to the base station computer.

It has been found that the base frequency for normal operation of a chairlift sheave assembly is, depending on the speed of the rope, between 10 Hz and 15 Hz. Any additional noise, created either by scratching of the rope against the sheave side plate or by a hitting of a metallic member against the support (as would occur during disintegration of a sheave), results in frequencies of approximately 70 Hz.

This sheave assembly vibration sensor is well suited as a safety device for any cable supported or cable driven systems in which sheave disintegration is a problem, e.g. ski lifts, ski handle tows, ski T-bars, platter lifts, carrier lifts, people movers, avalanche blasters, and material tramways.

Referring to FIGS. 6–9, a cable alignment sensor is designed to measure the magnetic resistance (Rm) between a rope and two sources of magnetic fields (inductors) located on opposite sides of the rope, both at a known distance (D). The magnetic resistance of each is proportional to this distance: Rm~D. The inductance (L) of each inductor is determined by the magnetic resistance: L~D/Rm. This means that one can determine the distance between the rope and an inductor by measuring the inductance. An easy way to measure the inductance (L) is to use an L/C oscillator with a constant capacitance (C). The frequency of this oscillator is than only proportional to the inductance: $f=(1/2\pi)(\sqrt{1/LC})$.

Even though at a constant capacitance the frequency of an oscillator, as described herein, is theoretically only a function of the inductance of its inductor and thus proportional to the distance of the inductor from the rope, in reality there are environmental factors, especially temperature, which will also effect the values of L and C. These influences can be reduced to a negligible minimum by using temperature stable components built physically close together, and by differential measurement of the oscillators' response (shifts in frequencies caused by movement of the rope). In this way the effects of environmental variables such as temperature and moisture in the air become common mode phenomena and should have little or no effect.

Referring to FIGS. 6–9, a magnetically permeable cable 40 (e.g. a steel cable as used in conventional chairlifts) is illustrated to be riding on a conventional sheave 36. Inductors, 60A and 60B, are mounted on opposite sides of the sheave assembly. A suitable inductor has the following properties: (a) a physical form which forces the magnetic flux to take a sufficient long way through the air, (b) the ability to operate at a frequency which is optimal of the cable material, (c) low losses due to eddy currents, and (d) high permeability. An example of an inductor is shown to be a conductive coil 62 wound about an open "C" core 64, such as an iron core. As illustrated, the open face of the core is directed toward the cable so that when the inductor is energized, the core does not provide a closed loop for the magnetic flux. However a permeable cable in the sheave groove magnetically close to the inductor reduces the magnetic resistance over that which would be felt otherwise. As the cable moves closer to an inductor (as would happen if the cable shifted out of the groove toward the inductor), the magnetic resistance of the inductor will be decreased which means that its inductance will be increased.

Referring again to FIGS. 6–9, the inductors are illustrated to have center taps 66 which communicate with respective L/C circuits of a pair of free running oscillators 68. The center taps allow the use of L/C oscillators operating in push-pull fashion in order to cover losses in the core material. Preferably the two oscillators are identical and built together in one electronic unit, i.e. on one circuit board close together so that drifts due to temperature effect both in the same way. The frequency of each oscillator is a function of the inductance of its coil and a selected capacitance. The value of the capacitance determines the frequency range and must be chosen according to the magnetic properties of the core (preferably iron) and the cable. In a series of experiments it was found that the optimal frequency range should be between 40 KHz and 50 KHz for a standard steel cable used on chairlifts.

The two inductors are installed symmetrically on opposite sides of the cable, magnetically close to the line of traction of the cable. If the sensors are made identical, they will have, ideally, the same inductance for a cable centered between them. If the cable shifts from the center toward one of the sensors, the inductance of the one sensor will increase while the inductance of the other one will decrease. Consequently, the frequency of one oscillator will decrease and the other will increase. Thus the two sensors provide differential information regarding the position of the cable.

Referring again to FIGS. 2 and 7, the oscillators 68 communicate their respective frequencies, 69A and 69B, to an interface/pulse-former circuit 70 which produces two respectively corresponding pulse trains, 18A and 18B, that are communicated to the processor 29 of the sensor's local interface unit 4. The pulse trains can be the sinusoidal signals from the oscillators squared-off into bipolar signals readable by the processor. In this case the processor simply measures the periods of the pulse trains to determine the frequencies of the oscillators for calculating the frequency differential. A self-learning algorithm run by the processor stores the difference between the two frequencies during normal operation. The frequency difference is used in order to minimize the influence of temperature on the frequencies since both oscillators are in the same environment and will drift in the same direction. In case the cable shifts from the ideal center line, the frequency difference will change dramatically. If this value exceeds a predetermined threshold, the processor sends a signal to the base station computer via the LAN. The base station computer is preprogrammed to distinguish between normal cable shifts and cable shifts which exceed the normal range. For those that exceed the normal range, the computer can also provide information as to whether the cable movement should be slowed down or stopped immediately.

The outputs of both oscillators could alternately be monitored with a frequency counter.

The cable alignment sensor according to this invention is well suited as a means for detecting lateral shifting of magnetically permeable cables used in any cable-supported and/or cable driven systems in which cable shifting can be a problem, e.g. ski resort chairlifts, handle tows, T-bars, platter lifts, gondola lifts, people movers, avalanche blasters, and material tramways.

Figure 10:
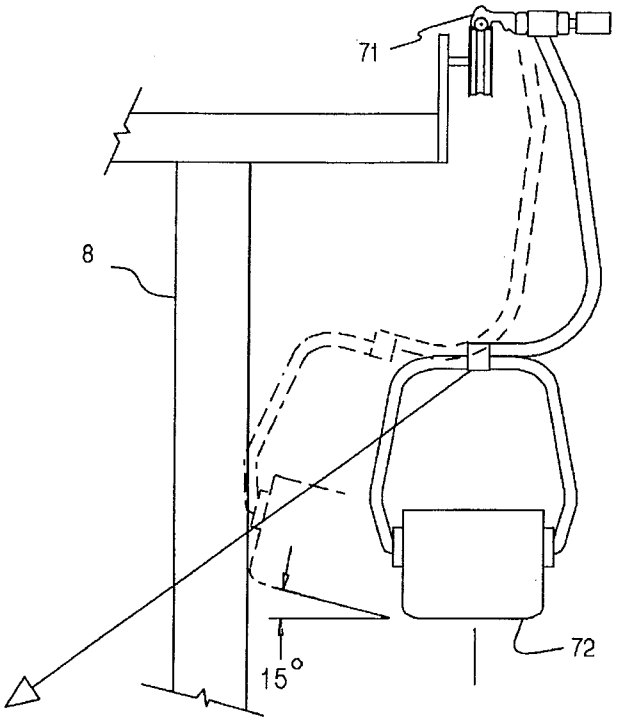
FIG. 10 is an illustration of a ropeway carrier passing by a cable tower, and illustrated in phantom is a ropeway carrier having excessive inclination striking the tower.

FIG. 10 depicts a safety problem inherent with ropeway carriers. In short, a swinging carrier 72 can be detached from its supporting cable either by excessive swinging motion, or more frequently by hitting a stationary object such as a cable tower 8. In such a case the carrier's clamp 71 is wrenched from the cable and the carrier and its occupants fall to the ground, often with disastrous results.

Figure 12:
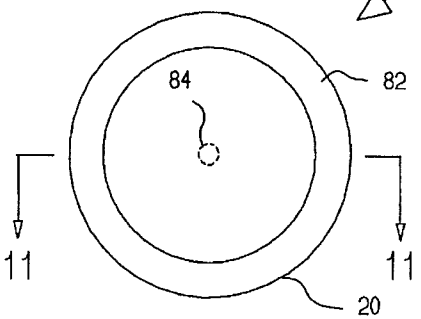
FIG. 12 is a plan view of the inclination switch of FIG. 11.
Figure 11:
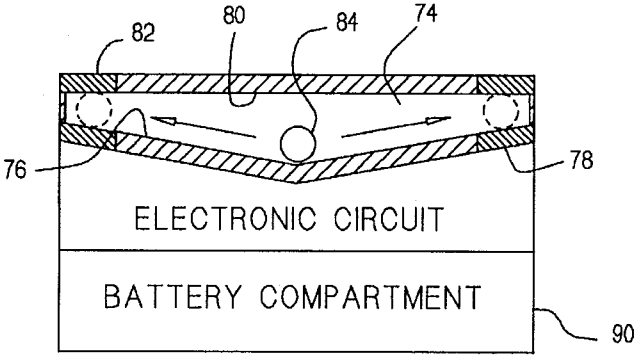
FIG. 11 is a sectional and diagrammatic representation of an inclination switch according to this invention.

Referring to FIGS. 11 and 12, an inclination sensor 20 is illustrated to have an hermetically sealed chamber 74. The floor 76 of the chamber is cone-shaped and non-conductive, e.g. plastic, except for the floor's rim 78 which is a contact ring. The ceiling 80 of the chamber can be an inverted bowl or flat as illustrated. The ceiling is also non-conductive except for the ceiling's rim 82 which is also a contact ring. The two contact rings are aligned in opposition and form a wedge around the rim of the chamber, and are preferably gold plated. Inside the chamber is a conductive ball 84, e.g. a gold plated ball. Electrical leads (not shown) provide communication between the hermetically sealed contact rings and external circuits. The chamber with the ball therein and the contact rings constitute an inclination switch 86. The inclination sensor is mounted on a ropeway carrier vertically in line with the carrier's center of gravity.

In operation when the carrier is still, the ball sits at the lowest point of the cone floor, but when the sensor is tilted, the ball tends to roll to the rim of the chamber. If the tilt is severe enough, the ball will roll into the wedge between the opposing contact rings touching both, and electrically closing the contacts. As mounted the inclination of the chamber floor, with respect to the horizontal, is preferably less than an unsafe inclination of the ropeway carrier such that the closure of the contact rings occurs before the carrier reaches an unsafe inclination. For example, the floor of the chamber illustrated in FIG. 11 has an inclination of 10° which is 5° less than the unsafe inclination illustrated in FIG. 10.

As described above the inclination switch is sensitive to an inclination of the ropeway carrier in all directions, an angular range of 360°. However closure "blind spots" can be created in line with the cable traction axis in order to prevent switch closure when the carrier is accelerated or stopped. This is easily done by covering the contact rings with an insulator at certain sectors. Also, the ball chamber can be filled with a relatively viscous fluid, such as ethylene glycol, to appropriately slow down movement of the ball.

Figure 13:
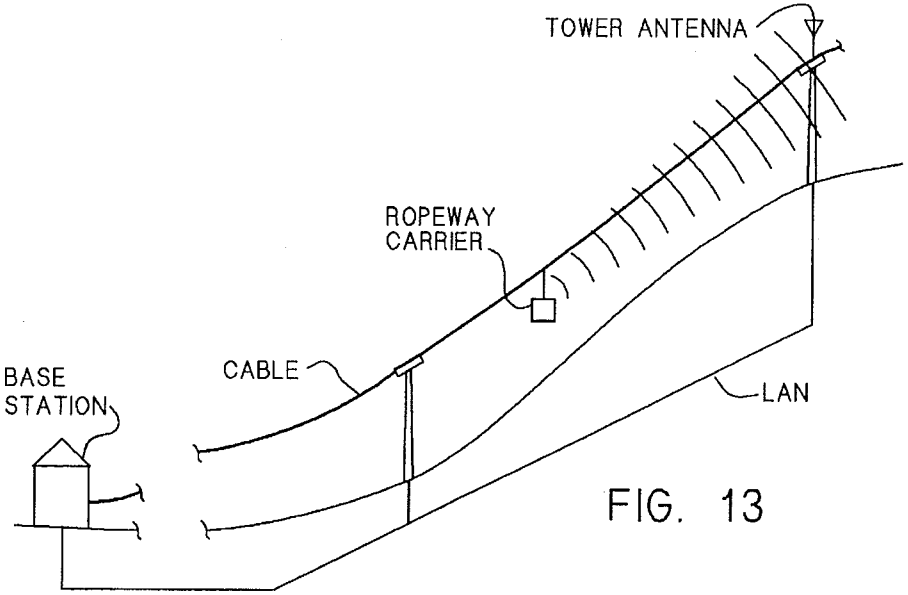
FIG. 13 is a diagrammatic representation of the communication link between a ropeway carrier and a tower.

Referring to FIGS. 11, 13 and 14, inclination switch closures produce signals that are communicated to a filter unit 88 that is powered by a lithium battery 90. The output of the filter unit is communicated to a microprocessor 92 (preferably CMOS). In order to save battery power the microprocessor, under normal conditions, is in a low current ("sleeping") mode, but is powered-up when an inclination switch closure occurs for a pre-defined period of time as determined by a time constant circuit in the filter unit. This prevents the start of the microprocessor if, due to normal vibrations, spurious contacts occur. When powered up, the microprocessor runs a software algorithm that checks the duration of the closure and the repetition rate. Because of the known physical dimensions of a ropeway carrier, the oscillation period of the carrier is a known constant depending on the load. If the closure time and the repetition rate of a swing exceed a predetermined pattern, the microprocessor will actuate the RF spread spectrum transmitter 22 which will broadcast a signal via a carrier antenna 94 to one or more tower antennae 96. (See also the antennae illustrated in FIG. 1). Each carrier transmitter has its own unique code and so included with the signal transmitted is the code of the carrier. The towers within broadcast range of the transmitter will relay the signal, with carrier code, to the base station computer via the LAN. The inclination sensor also periodically broadcasts a status signal to alert the base station computer that it is working properly.

Thus each ropeway carrier will have its own inclination sensor powered by a lithium battery which is especially suited for low temperatures. Since each carrier has its own unique code, the base station computer can also include a program for keeping track of the location of each carrier, so that when a carrier sensor sends an alarm signal it can be quickly located.

Referring to FIGS. 1 and 14, each ropeway carrier transmitter 22 has a unique code, and each time the transmitter's host carrier passes through the base station a base station transceiver 104 in communication with the base station computer emits a pulse to trigger a transmitter code transponder 102 on the carrier. The transponder is controlled by the carrier's microprocessor which passes the transmitter's code to the transponder. The transponder responds by transmitting the requested code. The transceiver and transponder need only have a range of several meters since they can be in close proximity whenever the carrier passes through the base station. In this way the base station computer can keep track of the exact whereabouts of each ropeway carrier on a cable simply by knowing the number and distribution of carriers on the cable. Likewise, each carrier and each carrier clamp can have unique codes and a similar transponder/transceiver arrangement to allow the system to control its carrier inventory and to schedule clamp maintenance or replacement according to the number of times a clamp is used. As illustrated the base station has a ropeway carrier code transceiver 110 and cooperating transponder 112, and a carrier clamp transceiver 114 and cooperating transponder 116.

Although a specific embodiment of an inclination switch is described above, basically any kind of inclination switch can be used which can provide a signal when the ropeway carrier is tilted at or beyond a selected angular limit. For example a mercury switches or micro-machined accelerometers with capacitive pick-up could be used. Also, the inclination switch can be modification or combination of other inclination switches.

The spread spectrum transmitters described above can be conventional transmitters which carry individual codes. One such transmitter/receiver system from RADIONICS can carry up to 255 uniquely coded transmitters. They communicate on the 902–928 MHZ frequency band. Because spread spectrum signals are short in duration and cover a wide range of frequencies, they are less effected by transmissions from other devices in the 900 MHZ band. Devices that typically operate in this frequency range usually transmit over a single frequency, but even a strong signal from one of these devices cannot effect the full spread spectrum transmission.

Optionally the system can also include a sensing unit to register each clamp and ropeway carrier arriving in a base station. This information can be used to log the number of opening and closing operations of each clamp and to determine the momentary location of each carrier on the cable track.

Referring to FIG. 1, optionally a central computer 100 can be the basis for a central control system used as a command center for all base station computers. The central computer can provide program updates, centralized back-up and restore functions, auditing and reporting functions, remote support, and to provide a supervisor the ability to monitor all cable systems.

Optionally, micro-mechanical vibration sensors can be attached to the gear box and the bearings of the cable driving mechanism. The outputs can be pre-conditioned similarly to the piezoelectric element signals in the sheave support vibration sensor, and then sent directly to the base station computer.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, the RF transmitters and receivers used for the ropeway carrier inclination sensors need not necessarily be spread spectrum devices, but could be any wireless transmission and reception devices capable of communicating signals from a carrier to a tower in the context as described above.

I claim:

1. A system for monitoring the safety of a ropeway comprising:

(a) means, responsive to misalignments of the cable from a normal line of cable traction, for producing signals ("cable misalignment signals") proportional to the amount of the misalignments, and (b) means for communicating the cable misalignment signals to a cable operator.

2. The system according to claim 1 wherein the means for communicating the cable misalignment signals to a cable operator comprises:

(a) base computer means for receiving cable misalignment signals and for providing corresponding indications to the cable operator, and (b) interface unit means for receiving cable misalignment signals originating locally to said interface unit means and relaying them to the base computer means.

3. The system according to claim 2 further comprising a data network communicating with the base computer means, and wherein said interface unit means further comprises means for communicating with the network for relaying signals to the base computer means.

4. The system according to claim 1 wherein the means responsive to misalignments of the cable comprises means, mounted on a cable sheave assembly, for producing magnetic flux that permeates the cable and for sensing the position of the cable relative to said normal line of cable traction as a function of the amount of said magnetic flux permeating the cable.

5. The system according to claim 4 wherein the means for communicating the cable misalignment signals to a cable operator comprises:

(a) base computer means for receiving cable misalignment signals and for providing corresponding indications to the cable operator, and (b) interface unit means, local to said means for producing cable misalignment signals, for relaying said cable misalignment signals to the base computer means.

6. The system according to claim 5 further comprising a data network communicating with the base computer means, and wherein the interface unit means further comprises means for communicating with the network for relaying signals to the base computer means.

7. The system according to claim 4 further comprising:

(a) means, mounted on a cable sheave assembly and responsive to at least those vibrations in said cable sheave assembly, for producing a signal ("sheave problem signal") corresponding thereto, and (b) means for communicating each sheave problem signal to a cable operator.

8. The system according to claim 7 wherein said means responsive to vibrations in a cable sheave assembly comprises:

(a) means for transducing vibrations within the sheave assembly to a corresponding signal, and (b) means for filtering-out components of said corresponding signal produced by normal operation of the sheave assembly, components of the signal not filtered-out being a sheave problem signal.

9. The system according to claim 7 wherein said means responsive to vibrations in a cable sheave assembly comprises:

(a) piezoelectric means, mounted against a supporting member of the sheave assembly, for producing a signal in response to mechanical pressure, (b) a free-floating mass disposed on a side of the piezoelectric means opposite the supporting member, (c) means for biasing the mass against the piezoelectric means, the amount of bias being sufficient to hold the mass against the piezoelectric means during vibrations produced by normal operation of the sheave assembly but insufficient to keep the mass from pounding the piezoelectric means during vibrations characteristic of disintegration within the sheave assembly, the piezoelectric means producing a sheave problem signal in response to said pounding.

10. A system for monitoring the safety of a ropeway comprising:

(a) a pair of open core inductors disposed symmetrically on opposite sides of a ropeway cable and magnetically close to the cable, (b) a corresponding pair of free-running oscillator circuits, the frequency of each oscillator circuit being a function of the inductance of its corresponding inductor, (c) means for detecting differential shifts in the frequencies of the oscillators, (d) means for producing a corresponding cable misalignment signal whenever a differential shift exceeds a predetermined threshold, and (e) means for communicating cable misalignment signals to a cable operator.

11. The system according to claim 10 wherein the means for communicating the cable misalignment signals to a cable operator comprises:

(a) base computer means for receiving cable misalignment signals and for providing corresponding indications to the cable operator, and (b) interface unit means, local to said means for producing cable misalignment signals, for relaying said cable misalignment signals to the base computer means.

12. The system according to claim 11 wherein the means for detecting differential shifts comprises processing means, incorporated in the interface unit means, for measuring the respective periods of oscillators' outputs and calculating differences between the periods.

13. The system according to claim 4 further comprising a data network communicating with the base computer means, and wherein the interface unit means further comprises means for communicating with the network for relaying signals to the base computer means.

14. A system for monitoring the safety of a ropeway comprising:

(a) means, responsive to misalignments of a ropeway cable from a normal line of cable traction, for producing signals ("cable misalignment signals") corresponding to the misalignments, (b) means for communicating the cable misalignment signals to a cable operator, (c) means, mounted on a cable sheave assembly and responsive to at least those vibrations in said cable sheave assembly that are characteristic of disintegration within the sheave assembly, for producing a signal ("sheave problem signal") corresponding thereto, and (d) means for communicating each sheave problem signal to a cable operator.

15. The system according to claim 14 wherein the means for communicating the cable misalignment signals and the means for communicating the sheave problem signals to a cable operator comprise:

(a) base computer means for receiving cable misalignment and sheave problem signals and for providing corresponding indications to the cable operator, (b) interface unit means, local to said means for producing cable misalignment signals, for relaying said signals to the base computer means, and (c) interface unit means, local to said means for producing said sheave problem signals, for relaying said signals to the base computer means.

16. The system according to claim 15 further comprising a data network communicating with the base computer means, and wherein each interface unit means further comprises means for communicating with the network for relaying signals to the base computer means.

17. The system according to claim 14 wherein said means responsive to vibrations in a cable sheave assembly comprises:

(a) means for transducing vibrations within the sheave assembly to a corresponding signal, and (b) means for filtering-out components of said corresponding signal produced by normal operation of the sheave assembly, components of the signal not filtered-out being a sheave problem signal.

18. The system according to claim 17 wherein the means for communicating the cable misalignment signals and the means for communicating the sheave problem signals to a cable operator comprise:

(a) base computer means for receiving cable misalignment and sheave problem signals and for providing corresponding indications to the cable operator, (b) interface unit means, local to said means for producing cable misalignment signals, for relaying said signals to the base computer means, and (c) interface unit means, local to said means for producing the sheave problem signals, for relaying said signals to the base computer means.

19. The system according to claim 18 further comprising a data network communicating with the base computer means, and wherein each interface unit means further comprises means for communicating with the network for relaying signals to the base computer means.

20. The system according to claim 14 wherein said means responsive to vibrations in a cable sheave assembly comprises:

(a) piezoelectric means, mounted against a supporting member of the sheave assembly, for producing a signal in response to mechanical pressure, (b) a free-floating mass disposed on a side of the piezoelectric means opposite the supporting member, (C) means for biasing the mass against the piezoelectric means, the amount of bias being sufficient to hold the mass against the piezoelectric means during vibrations produced by normal operation of the sheave assembly but insufficient to keep the mass from pounding the piezoelectric means during vibrations characteristic of disintegration within the sheave assembly, the piezoelectric means producing a sheave problem signal in response to said pounding.

21. The system according to claim 20 wherein the means for communicating each sheave problem signal to a cable operator comprise:

(a) a data network, (b) base computer means for receiving via the network sheave problem signals and for providing corresponding indications to the cable operator, and (c) interface unit means, local to said means for producing the sheave problem signals, for relaying said signals to the base computer means via the network.

22. The system according to claim 21 wherein each interface unit means further comprises:

(a) an analog-to-digital converter, (b) means for receiving and multiplexing a plurality of analog sheave problem signals from a corresponding number of said means for producing same to an analog input of the converter, the output of the converter being digitized sheave problem signals, (c) network interface means for communicating the digitized sheave problems to the base computer means, and (d) processing means for controlling the sequence of multiplexing and the network interface means.

23. The system according to claim 14 further comprising:

(a) means, mounted on a ropeway carrier supported by the cable and responsive to an excessive swing of the ropeway carrier, for producing a signal ("excessive swing signal") corresponding thereto, and (b) means for communicating excessive swing signals to a cable operator.

24. The system according to claim 23 wherein the means for communicating cable misalignment signals, the means for communicating sheave problem signals and the means for communicating excessive swing signals to a cable operator comprise:

(a) base computer means for receiving cable misalignment, sheave problem signals and excessive swing signals, and for providing corresponding indications to the cable operator, (b) means, at the ropeway carrier, for broadcasting excessive swing signals originating therefrom, (c) means, mounted on a cable support structure, for receiving broadcast excessive swing signals, (d) interface unit means, local to said means for producing cable misalignment signals, for relaying said signals to the base computer means, (e) interface unit means, local to said the means for producing sheave problem signals, for relaying said signals to the base computer means, and (f) interface unit means, local to said means for receiving broadcast excessive swing signals, for relaying said signals to the base computer means.

25. The system according to claim 24 wherein the means for broadcasting and receiving the excessive swing signals comprises a spread spectrum RF transmitter and a spread spectrum RF receiver, respectively.

26. The system according to claim 25 further comprising a data network communicating with the base computer means, and wherein each interface unit means further comprises means for communicating with the network for relaying signals to the base computer means.

27. The system according to claim 24 further comprising a data network communicating with the base computer means, and wherein each interface unit means further comprises means for communicating with the network for relaying signals to the base computer means.

28. The system according to claim 23 wherein said means for producing the excessive swing signals comprises:

(a) means for producing a signal ("tilt signal") whenever the ropeway carrier is inclined beyond a predetermined threshold angle of inclination, (b) means for measuring the duration and repetition rate of tilt signals, and (c) means for producing an excessive swing signal whenever a duration or a repetition rate exceeds a predetermined corresponding threshold.

29. The system according to claim 28 wherein the means for communicating cable misalignment signals, the means for communicating sheave problem signals and the means for communicating excessive swing signals to a cable operator comprise:

(a) base computer means for receiving cable misalignment, sheave problem signals and excessive swing signals, and for providing corresponding indications to the cable operator, (b) means, at the ropeway carrier, for broadcasting excessive swing signals originating therefrom, (c) means, mounted on a cable support structure, for receiving broadcast excessive swing signals, (d) interface unit means, local to said means for producing cable misalignment signals, for relaying said signals to the base computer means, (e) interface unit means, local to said means for producing sheave problem signals, for relaying said signals to the base computer means, and (f) interface unit means, local to said means for receiving broadcast excessive swing signals, for replaying said signals to the base computer means.

30. The system according to claim 29 wherein the means for broadcasting and receiving the excessive swing signals comprises a spread spectrum RF transmitter and a spread spectrum RF receiver, respectively.

31. The system according to claim 30 further comprising a data network communicating with the base computer means, and wherein each interface unit means further comprises means for communicating with the network for relaying signals to the base computer means.

32. The system according to claim 29 further comprising a data network communicating with the base computer means, and wherein each interface unit means further comprises means for communicating with the network for relaying signals to the base computer means.

33. A system for monitoring the safety of a ropeway comprising:

(a) means, responsive to misalignments of a ropeway cable from a normal line of cable tractions, for producing signals ("cable misalignment signals") corresponding to the misalignments, (b) means for communicating the cable misalignment signals to a cable operator, (c) means, mounted on a ropeway carrier supported by the cable and responsive to an excessive swing of the ropeway carrier, for producing a signal ("excessive swing signal") corresponding thereto, and (d) means for communicating excessive swing signals to a cable operator.

34. The system according to claim 33 wherein said means for producing the excessive swing signals comprises:

(a) means for producing a signal ("tilt signal") whenever the ropeway carrier is inclined beyond a predetermined threshold angle of inclination, (b) means for measuring the duration and repetition rate of tilt signals, and (c) means for producing an excessive swing signal whenever a duration or a repetition rate exceeds a predetermined corresponding threshold.

35. A system for monitoring the safety of a ropeway comprising:

(a) means, mounted on a cable sheave assembly of the ropeway, for producing magnetic flux that permeates the cable and for sensing the position of the cable relative to a normal line of cable traction as a function of the amount of said magnetic flux permeating the cable, and for producing signals ("cable misalignment signals") corresponding to the misalignments, (b) means for communicating the cable misalignment signals to a cable operator, (c) means, mounted on a ropeway carrier supported by the cable and responsive to an excessive swing of the ropeway carrier, for producing a signal ("excessive swing signal") corresponding thereto, and (d) means for communicating excessive swing signals to a cable operator.

36. The system according to claim 35 wherein said means for producing the excessive swing signals comprises:

(a) means for producing a signal ("tilt signal") whenever the ropeway carrier is inclined beyond a predetermined threshold angle of inclination, (b) means for measuring the duration and repetition rate of tilt signals, and (c) means for producing an excessive swing signal whenever a duration or a repetition rate exceeds a predetermined corresponding threshold.

37. A system for monitoring the safety of a ropeway comprising:

(a) means, mounted on a cable sheave assembly and responsive to at least those vibrations in said cable sheave assembly that are characteristic of disintegration within the sheave assembly, for producing a signal ("sheave problem signal") corresponding thereto, and (b) means for communicating each sheave problem signal to a cable operator.

38. The system according to claim 37 wherein the means for communicating the sheave problem signals to a cable operator comprises:

(a) base computer means for receiving sheave problem signals and for providing corresponding indications to the cable operator, and (b) interface unit means, local to said means for producing said sheave problem signals, for relaying said signals to the base computer means.

39. The system according to claim 38 further comprising a data network communicating with the base computer means, and wherein the interface unit means further comprises means for communicating with the network for relaying signals to the base computer means.

40. The system according to claim 37 wherein said means responsive to vibrations in a cable sheave assembly comprises:

(a) means for transducing vibrations within the sheave assembly to a corresponding signal, and (b) means for filtering-out components of said corresponding signal produced by normal operation of the sheave assembly, components of the signal not filtered-out being a sheave problem signal.

41. The system according to claim 40 wherein the means for communicating the sheave problem signals to a cable operator comprise:

(a) base computer means for receiving sheave problem signals and for providing corresponding indications to the cable operator, and (b) interface unit means, local to said means for producing the sheave problem signals, for relaying said signals to the base computer means.

42. The system according to claim 41 further comprising a data network communicating with the base computer means, and wherein each interface unit means further comprises means for communicating with the network for relaying signals to the base computer means.

43. The system according to claim 37 wherein said means responsive to vibrations in a cable sheave assembly comprises:

(a) piezoelectric means, mounted against a supporting member of the sheave assembly, for producing a signal in response to mechanical pressure, (b) a free-floating mass disposed on a side of the piezoelectric means opposite the supporting member, (c) means for biasing the mass against the piezoelectric means, the amount of bias being sufficient to hold the mass against the piezoelectric means during vibrations produced by normal operation of the sheave assembly but insufficient to keep the mass from pounding the piezoelectric means during vibrations characteristic of disintegration within the sheave assembly, the piezoelectric means producing a sheave problem signal in response to said pounding.

44. The system according to claim 43 wherein the means for communicating each sheave problem signal to a cable operator comprise:

(a) a data network, (b) base computer means for receiving via the network sheave problem signals and for providing corresponding indications to the cable operator, and (c) interface unit means, local to said means for producing the sheave problem signals, for relaying said signals to the base computer means via the network.

45. The system according to claim 44 wherein each interface unit means further comprises:

(a) an analog-to-digital converter, (b) means for receiving and multiplexing a plurality of analog sheave problem signals from a corresponding number of said means for producing same to an analog input of the converter, the output of the converter being digitized sheave problems signals, (c) network interface means for communicating the digitized sheave problems to the base computer means, and (d) means for controlling the sequence of multiplexing and the network interface means.

46. The system according to claim 37 further comprising:

(a) means, mounted on a ropeway carrier supported by the cable and responsive to an excessive swing of the ropeway carrier, for producing a signal ("excessive swing signal") corresponding thereto, and (b) means for communicating excessive swing signals to a cable operator.

47. The system according to claim 46 wherein the means for communicating sheave problem signals and the means for communicating excessive swing signals to a cable operator comprise:

(a) base computer means for receiving sheave problem signals and excessive swing signals, and for providing corresponding indications to the cable operator, (b) means, at the ropeway carrier, for broadcasting excessive swing signals originating therefrom, (c) means, mounted on a cable support structure, for receiving broadcast excessive swing signals, (d) interface unit means, local to said means for producing sheave problem signals, for relaying said signals to the base computer means, and (e) interface unit means, local to said means for receiving broadcast excessive swing signals, for relaying said signals to the base computer means.

48. The system according to claim 47 wherein the means for broadcasting and receiving the excessive swing signals comprises a spread spectrum RF transmitter and a spread spectrum RF receiver, respectively.

49. The system to claim 48 further comprising a data network communicating with the base computer means, and wherein each interface unit means further comprises means for communicating with the network for relaying signals to the base computer means.

50. The system according to claim 47 further comprising a data network communicating with the base computer means, and wherein each interface unit means further comprises means for communicating with the network for relaying signals to the base computer means.

51. The system according to claim 46 wherein said means for producing the excessive swing signals comprises:

(a) means for producing a signal ("tilt signal") whenever the ropeway carrier is inclined beyond a predetermined threshold angle of inclination, (b) means for measuring the duration and repetition rate of tilt signals, and (c) means for producing an excessive swing signal whenever a duration or a repetition rate exceeds a predetermined corresponding threshold.

52. The system according to claim 51 wherein the means for communicating sheave problem signals and the means for communicating excessive swing signals to a cable operator comprise:

(a) base computer means for receiving sheave problem signals and excessive swing signals, and for providing corresponding indications to the cable operator, (b) means, at the ropeway carrier, for broadcasting excessive swing signals originating therefrom, (c) means, mounted on a cable support structure, for receiving broadcast excessive swing signals, (d) interface unit means, local to said means for producing sheave problem signals, for relaying said signals to the base computer means, and (e) interface unit means, local to said means for receiving broadcast excessive swing signals, for relaying said signals to the base computer means.

53. The system according to claim 52 wherein the means for broadcasting and receiving the excessive swing signals comprises a spread spectrum RF transmitter and a spread spectrum RF receiver, respectively.

54. The system according to claim 53 further comprising a data network communicating with the base computer means, and wherein each interface unit means further comprises means for communicating with the network for relaying signals to the base computer means.

55. The system according to claim 52 further comprising a data network communicating with the base computer means, and wherein each interface unit means further comprises means for communicating with the network for relaying signals to the base computer means.

56. A system for monitoring the safety of a ropeway comprising:

(a) means, mounted on a ropeway carrier supported by the cable and responsive to an excessive swing of the ropeway carrier, for producing a signal ("excessive swing signal") corresponding thereto, and (b) means for communicating excessive swing signals to a cable operator.

57. The system according to claim 56 wherein said means for communicating excessive swing signals to a cable operator comprises:

(a) base computer means for receiving excessive swing signals and for providing corresponding indications to the cable operator, (b) means, at the ropeway carrier, for broadcasting excessive swing signals originating therefrom, (c) means, mounted on a cable support structure, for receiving broadcast excessive swing signals, and (d) interface unit means, local to said means for receiving broadcast excessive swing signals, for relaying said signals to the base computer means.

58. The system according to claim 57 wherein said means for broadcasting and receiving the excessive swing signals comprises a spread spectrum RF transmitter and a spread spectrum RF receiver, respectively.

59. The system according to claim 58 further comprising a data network communicating with the base computer means, and wherein the interface unit means further comprises means for communicating with the network for relaying signals to the base computer means.

60. The system according to claim 57 further comprising a data network communicating with the base computer means, and wherein the interface unit means further comprises means for communicating with the network for relaying signals to the base computer means.

61. The system according to claim 56 wherein said means for producing the excessive swing signals comprises:

(a) means for producing a signal ("tilt signal") whenever the ropeway carrier is inclined beyond a predetermined threshold angle of inclination, (b) means for measuring the duration and repetition rate of tilt signals, and (c) means for producing an excessive swing signal whenever a duration or a repetition rate exceeds a predetermined corresponding threshold.

62. The system according to claim 61 wherein the means for communicating excessive swing signals to a cable operator comprises:

(a) base computer means for receiving excessive swing signals and for providing corresponding indications to the cable operator, (b) means, at the ropeway carrier, for broadcasting excessive swing signals originating therefrom, (c) means, mounted on a cable support structure, for receiving broadcast excessive swing signals, and (d) interface unit means, local to said means for receiving broadcast excessive swing signals, for relaying said signals to the base computer means.

63. The system according to claim 62 wherein the means for broadcasting and receiving the excessive swing signals comprises a spread spectrum RF transmitter and a spread spectrum RF receiver, respectively.

64. The system according to claim 63 further comprising a data network communicating with the base computer means, and wherein the interface unit means further comprises means for communicating with the network for relaying signals to the base computer means.

65. The system according to claim 62 further comprising a data network communicating with the base computer means, and wherein the interface unit means further comprises means for communicating with the network for relaying signals to the base computer means.

* * * * *